US006454204B1

(12) United States Patent
Reuter et al.

(10) Patent No.: US 6,454,204 B1
(45) Date of Patent: Sep. 24, 2002

(54) ROTATABLE SUPPORTING ELEMENT

(75) Inventors: Elisabeth Reuter, Wermelskirchen (DE); Wolfgang Loebig, Schauenburg (DE)

(73) Assignees: Spanntec GmbH Spann-und Wickeltechnik, Bad Iburg (DE); AIK Faserverbundtechnik Gesellschaft mit beschraenkter Haftung, Kassel (DE)

( * ) Notice: Subject to any disclaimer, the term of this patent is extended or adjusted under 35 U.S.C. 154(b) by 0 days.

(21) Appl. No.: 09/520,069

(22) Filed: Mar. 7, 2000

(30) Foreign Application Priority Data

Mar. 10, 1999 (DE) ..... 199 10 475

(51) Int. Cl.[7] ..... B65H 75/18; B65H 49/26
(52) U.S. Cl. ..... 242/599; 242/597.5
(58) Field of Search ..... 242/597, 597.5, 242/596.7, 609, 609.4, 613, 613.1

(56) References Cited

U.S. PATENT DOCUMENTS

| | | | | | |
|---|---|---|---|---|---|
| 368,606 | A | * | 8/1887 | Parker | |
| 1,066,319 | A | * | 7/1913 | Powell | |
| 2,621,867 | A | | 12/1952 | Grettve | |
| 2,711,863 | A | | 6/1955 | Grettve | |
| 3,029,037 | A | | 4/1962 | Williams et al. | |
| 3,737,030 | A | * | 6/1973 | Stewart | 206/59 E |
| 3,794,260 | A | * | 2/1974 | Sowell | 242/125.1 |
| 3,813,098 | A | * | 5/1974 | Fischer et al. | 273/72 R |
| 4,187,135 | A | * | 2/1980 | Yates | 156/187 |
| 4,188,032 | A | * | 2/1980 | Yanagioka | 273/80 |
| 4,854,516 | A | * | 8/1989 | Yamada | 242/43.2 |
| 5,669,576 | A | * | 9/1997 | Moody | 242/560.3 |
| 5,803,398 | A | * | 9/1998 | May et al. | 242/547 |
| 5,984,544 | A | * | 11/1999 | Lippold et al. | 396/648 |
| 6,073,868 | A | * | 6/2000 | Stevens et al. | 242/118.32 |

FOREIGN PATENT DOCUMENTS

| | | | | |
|---|---|---|---|---|
| DE | 2030322 | | 2/1971 | |
| DE | 2150991 | | 5/1972 | |
| DE | 8406019 | | 5/1984 | |
| DE | 4342341 | | 10/1994 | |
| JP | 6-1350 | * | 1/1994 | B65H/54/547 |
| JP | 10249916 A | * | 9/1998 | |

* cited by examiner

*Primary Examiner*—Donald P. Walsh
*Assistant Examiner*—Joseph C. Rodriguez
(74) *Attorney, Agent, or Firm*—Jordan and Hamburg LLP

(57) ABSTRACT

The invention relates to a rotatable supporting element for accommodating winding tubes, plug-in adapters or the like with a supporting body and a casing, which surrounds the supporting body and is connected with it indissolubly in sleeve fashion and comprises a material which is different from and has a greater hardness than that of the supporting body. The casing has at least one stress-relieving region which extends in ring-shaped fashion about its periphery and is formed by a region of reduced material thickness or by a material-free region. By means of this configuration, stress peaks in the casing and uncontrolled tearing or breaking of the casing are avoided.

26 Claims, 3 Drawing Sheets

ROTATABLE SUPPORTING ELEMENT

BACKGROUND OF THE INVENTION

The invention relates to a rotatable supporting element. The supporting elements may be supported at both ends, as in the case, for example, of winding shafts, winding pins or supporting pipes, as well as only at one end, as in the case, for example, of winding heads. The supporting function can be accomplished with or without clamping devices in the usual types of construction.

Generic supporting elements consist at least of a supporting body which, because of the supporting function, is manufactured from a material with high strength values, such as a high fatigue strength under reverse bending stresses and a high modulus of elasticity. A casing, generally of a metallic material, is associated with the supporting body and functions as wear protection layer and for achieving a low surface roughness and a subsequent surface finish of good surface hardness, for example, by anodizing, without having to fulfill a supporting function. The material of the casing generally has a greater hardness than the material of the supporting body and is correspondingly brittle and has a lower fatigue strength under reverse bending stresses. When used in the intended manner, supporting elements, due to their rapid rotation, are exposed to appreciable alternating bending loads. This frequently leads to breakage of the casing, although the load-carrying capability of the supporting body has not yet been reached. The cracks or breaks thus arising increase the risk of an accident due to cuts. Also, because the material flares at these places, the handling of parts, which are to be pushed on, such as winding tubes or plug-in adapters, which may catch on these flares, is made difficult. Finally, the visual impression of such supporting elements with a damaged casing is not satisfactory. In order to avoid such damage, supporting elements are therefore frequently dimensioned in practice so that, with respect to strength, they are dimensioned for the weakest material, which usually is the casing. With that, the normally higher fatigue strength under repeated reverse bending stresses of the supporting object used cannot be utilized.

SUMMARY OF THE INVENTION

It is therefore an object of the invention to provide a generic supporting element, which shows an improved use behavior and, in particular, is damaged less in use, so that the possibility of injury or interference with the handling is reduced.

Since at least one stress-relieving region, extending annularly about the periphery of the casing, is provided as a material-free region or a corresponding region of reduced material thickness, a zone is created there, which makes a selective yielding of the casing possible without the development of undesirable phenomena, such as cracks or material flaring, etc. If the stress-relieving regions are constructed by reducing the thickness of the material of the casing, then the casing, when the maximum fatigue strength under repeated reverse bending stresses of the casing material is exceeded, tears selectively in these regions, which are designed as predetermined breaking points. Due to the lesser thickness of the material in these regions, there is no flaring and there are no sharp, protruding edges. If the casing is provided with one or several material-free regions, which extend annularly about its periphery, the casing pieces, which are formed, are shorter than those formed by a continuous casing. As a result, cracks no longer occur and the casing can be designed so that it withstands the same alternating bending loads that the supporting body withstands.

Further advantages and details arise from the examples of the invention, which are explained in the following and shown in the accompanying drawings.

BRIEF DESCRIPTION OF THE PREFERRED EMBODIMENTS

Figure 1:
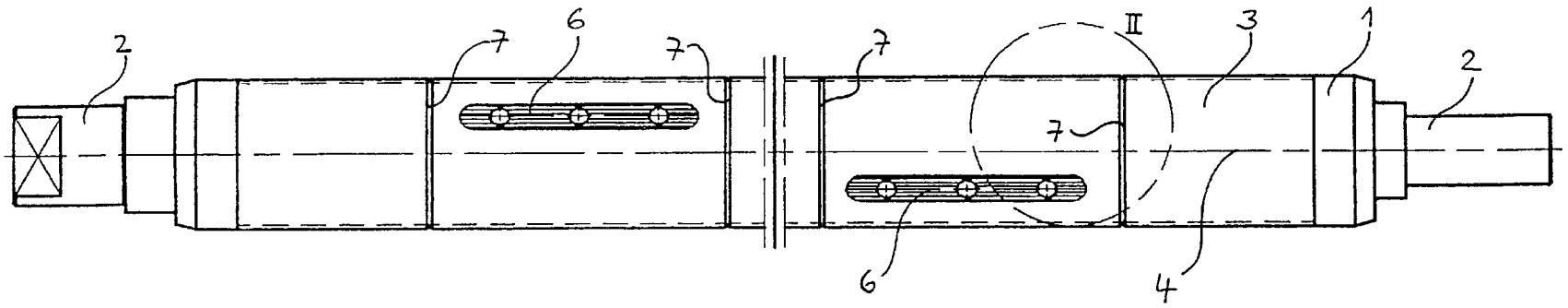
FIG. 1 diagrammatically shows an inventive supporting element.

The supporting element, shown in FIG. 1, is a winding shaft for winding up and unwinding flexible flat material on appropriate winding tubes. The winding shaft has a supporting body 1 with a middle region for accommodating a winding tube and bearing regions 2 at either end. The middle region of the supporting body 1 is surrounded by a casing 3, which has several recesses 5 extending longitudinally and ovally in the direction of the axis of rotation 4 of the winding shaft. The clamping elements, constructed as tensioning bars 6, pass through the recesses 5. The tensioning bars 6 can be moved outward in the radial direction by means of an expansion mechanism, which is not shown. They clamp and fix the winding tube pushed onto the winding shaft.

The supporting body 1 consists of a composite fiber material of high fatigue strength under repeated reverse bending stresses, such as a carbon fiber-reinforced reaction resin or a fiberglass composite. On the other hand, the casing 3 functions as a layer protecting against wear and consists of a metallic material, preferably aluminum or steel. Several stress-relieving regions 7, which prevent the uncontrolled tearing and breaking of the casing 3, extend in ring-shaped fashion around the periphery of the casing 3. Preferably, these stress-relieving regions 7 are disposed in the critical stress zones of the casing 3, in which damage to the casing usually occurs in conventional supporting elements. These critical stress zones are located, in particular, in the vicinity of the tensioning bars 6, since the recesses 5, which are located there in the casing 3, exert an additional notch effect on these. Further critical stress zones frequently are disposed in the outer region of the supporting elements in the vicinity of the bearing regions 2.

Figure 2:
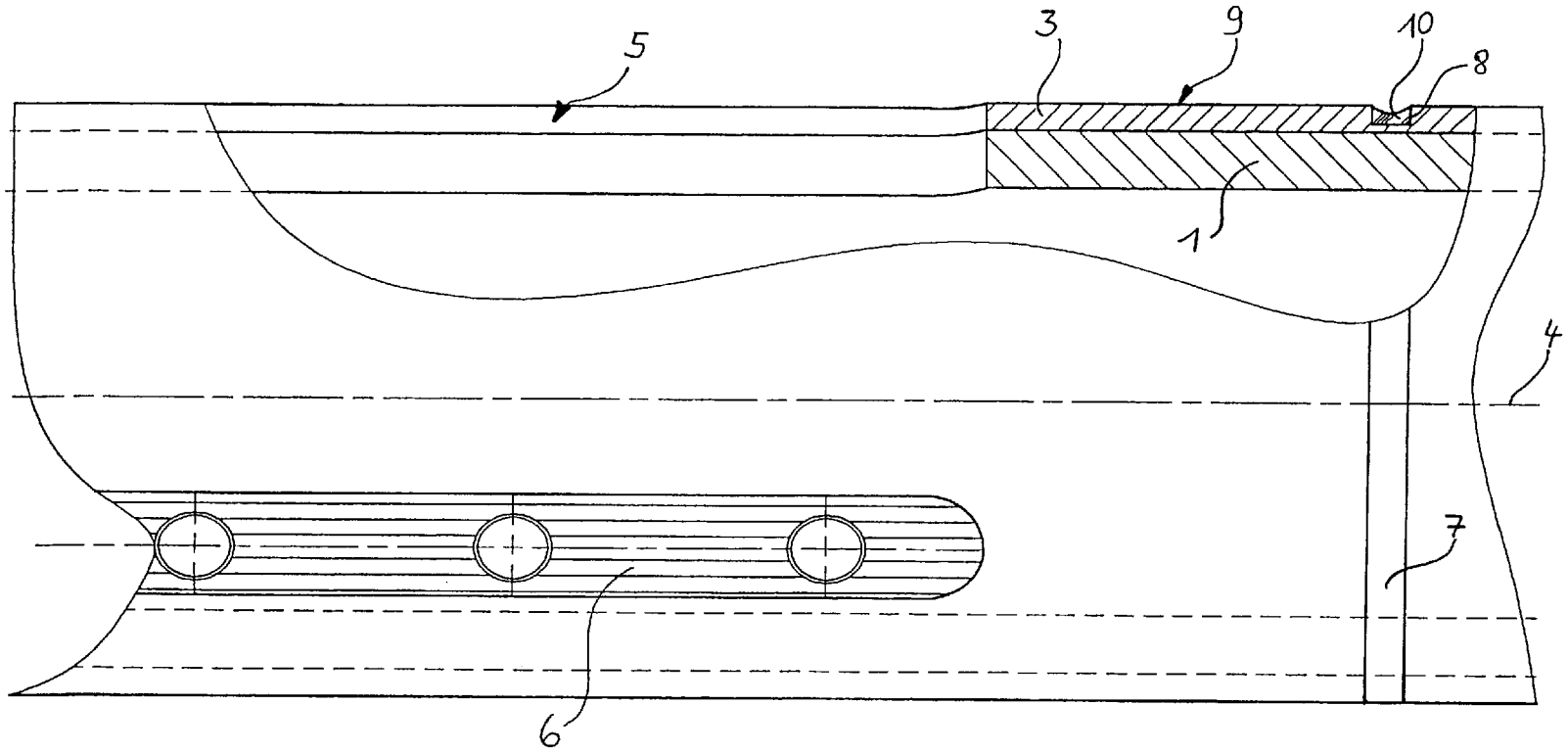
FIG. 2 shows an enlargement of section II of FIG. 1, partially in a sectional view.
Figure 3:
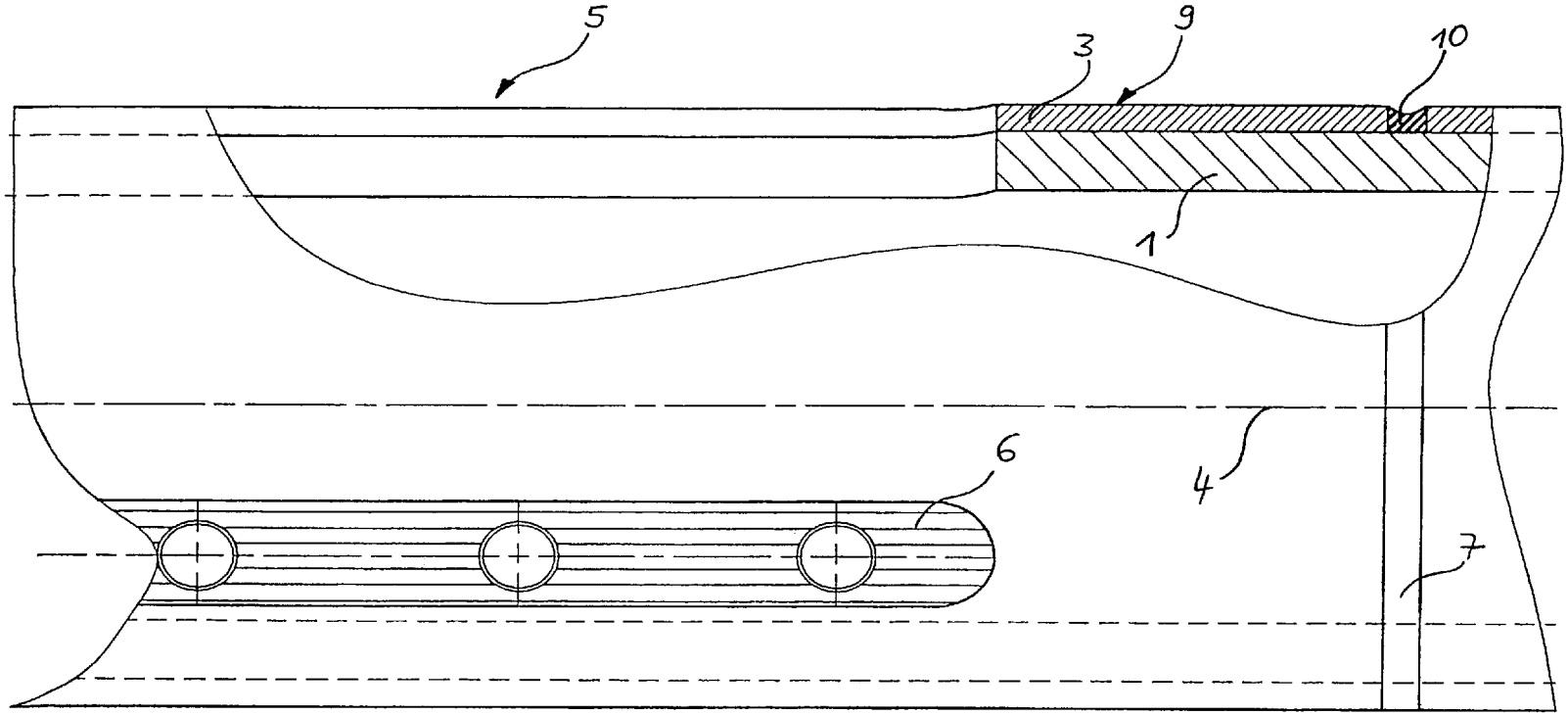
FIG. 3 shows a view, corresponding to that of FIG. 2, of a different embodiment.

In FIGS. 2 and 3, a portion of the winding shaft of FIG. 1 is shown in two different embodiments on a larger scale, partially in section. It can be seen in FIG. 2 that the stress-relieving region 7 shown is formed by an annular groove 8, which is open toward the outside. As a result, the material is deliberately weakened in this region. Consequently, a predetermined breaking point is provided there, in which the casing 3 tears when the fatigue strength under repeated reverse bending stresses is impermissibly exceeded, without thereby decreasing the carrying power of the supporting element, since this carrying power is determined by the supporting body 1. However, since there is less material in the stress-relieving area than in the remainder of the casing 3, material flaring, which could protrude beyond the outer surface 9 of the casing 3, does not take place in spite of the tearing. It is also particularly advantageous to design the region of reduced material thickness as an annular groove 8, open to the outside, since the predetermined breaking point recedes behind the outer surface 9 of the casing 3 and the danger of injury by skin contact, etc. is reduced even further. Moreover, such a winding shaft can be produced simply, since the casing 3, which initially does not yet have any stress-relieving regions 7, is pushed onto the supporting body 1 and shrunk on or glued on there and the annular groove 8 is recessed or otherwise introduced only in a further step of the process.

Preferably, the stress-relieving regions 7 are filled at least partially with a flexible composition 10, as shown. This composition 10 should be sufficiently elastic so that it continues to adhere in these regions even when the casing 3 tears there or if parts of the casing are shifted relative to one another. By these means, the risk of an injury is reduced further, since sharp edges cannot be contacted. The supporting element then also always gives a satisfactory impression visually. Moreover, filling with a flexible composition makes the surface of the casing 3 smooth, which furthermore makes it easier to handle the supporting element. Moreover, the flexible composition 10 prevents the accumulation of dirt in the stress-relieving region 7. Supporting elements with, for example, different stress limits or intended uses can be marked by dyeing the flexible compositions 10 with different colors, thus making it easier to select the correct supporting elements when fitting or exchanging supporting elements. This marking can represent an additional protection against accidents for the personnel, since confusion and the use of wrong supporting elements are precluded.

FIG. 3 shows a further embodiment, for which the stress-relieving region 7 is constructed as a material-free region instead of as an annular groove. This material-free region is also advantageously filled with a flexible composition 10.

What we claim is:

1. A rotatable supporting element for accommodating winding tubes or plug-in adapters comprising:

a supporting body; and a casing which surrounds said supporting body, is connected with said supporting body in sleeve fashion and comprises a material which is different from and has a greater hardness than that of said supporting body, said casing having at least one stress-relieving region, each of said at least one stress-relieving region extending only over a portion of said casing in ring-shaped fashion about its periphery and being formed by a region of reduced material thickness or by a material-free region, said stress-relieving region being filled at least partially with a flexible composition, said flexible composition being dyed in order to characterize it.

2. A rotatable supporting element for accommodating winding tubes or plug-in adapters comprising:

a supporting body; and a casing surrounding said supporting body, said casing being connected with said supporting body in sleeve fashion and being made of a material which is different from and has a greater hardness than that of said supporting body, said casing having at least one stress-relieving region, each of said at least one stress-relieving region extending only over a portion of said casing in ring-shaped fashion about its periphery and being formed by a region of reduced material thickness or by a material-free region to enable selective yielding of said casing during bending, said supporting body comprising a composite fiber material, and said casing comprising a metallic material.

3. The rotatable supporting element of claim 2, further comprising longitudinally extending tensioning bars arranged in connection with said supporting body, said at least one stress-relieving region comprising a plurality of stress-relieving regions, said stress-relieving regions being arranged proximate said tensioning bars.

4. The rotatable supporting element of claim 2, wherein said casing has a thickness, said at least one stress-relieving region being a region of reduced material thickness formed by an annular groove extending only partially through the thickness of said casing.

5. The rotatable supporting element of claim 2, wherein casing has a thickness, said at least one stress-relieving region being a material free region such that said casing is separated by each of said at least one stress-relieving region into parts.

6. The rotatable supporting element of claim 2, wherein each of said at least one stress-relieving region is situated between non-stress-relieving regions.

7. The rotatable supporting element of claim 2, wherein said at least one stress-relieving regions comprise a plurality of stress-relieving regions, said stress-relieving regions being arranged at longitudinal locations along an axis of said casing to enable selective yielding of said casing during bending.

8. A method of reducing stress in a rotatable supporting element which includes a supporting body and a casing which surrounds the supporting body and which is connected with the supporting body in sleeve fashion, the casing being made of a material in tubular form, the method comprising the steps of:

providing at least one stress-relieving region each extending only over a portion of the casing in a ring-shaped manner about a periphery of the casing by locally reducing a thickness of the material entirely to thereby form at least one region of reduced material thickness or a material-free region and separate the casing into discrete parts such that the at least one stress-relieving region enables selective yielding of the casing during bending.

9. A method according to claim 8, wherein at least one material-free region is formed, further comprising the step of at least partially filling the at least one material-free region with a flexible composition.

10. A method according to claim 8, further comprising the step of constructing the casing and the supporting body of different materials, the casing being made of a material having a greater hardness than another material from which the supporting body is made.

11. The method of claim 8, wherein at least one region of reduced material thickness is formed.

12. The method of claim 8, wherein the at least one stress-relieving region comprises a plurality of stress-relieving regions, further comprising the steps of:

arranging longitudinally extending tensioning bars in connection with the supporting body; and arranging the stress-relieving regions proximate the tensioning bars.

13. The method of claim 8, wherein the at least one stress-relieving region is a material-free region such that the casing is separated into parts by the at least one stress-relieving regions.

14. The method of claim 8, further comprising the steps of:

determining a location of critical stress zones of the casing; and arranging at least one stress-relieving region in each critical stress zone.

15. A rotatable supporting element, comprising:

a supporting body subject to alternating bending loads;

a metallic wear-resistant casing surrounding said supporting body, said casing having an outer cylindrical surface, said casing being connected with said supporting body to preclude relative movement between said casing and said supporting body, said casing having a greater hardness than said supporting body; and said casing having an outer cylindrical surface and including at least one weakened stress-relieving region which includes a groove which is open to the outer cylindrical surface of said casing, said groove being defined by a region of reduced material thickness which has a predetermined breaking point such that the region of reduced material thickness tears and produces flares and protruded metallic edges upon being subject to alternating bending loads which exceed said predetermined breaking point, said flares and protruded metallic edges being confined within said groove and thereby being precluded from extending radially outwardly of the outer cylindrical surface of said casing.

16. The supporting element of claim 15, wherein said at least one stress-relieving region is arranged in a critical stress zone of said casing.

17. A supporting element according to claim 15, wherein said casing is configured for accommodating an article selected from a group consisting of winding tubes and plug-in adapters.

18. A supporting element according to claim 15, wherein the stress-relieving region is at least partially filled with a flexible composition.

19. A supporting element according to claim 18, wherein said flexible composition is sufficiently elastic such that it continues to adhere in said stress-relieving region when parts of said casing on either side thereof shift relative one another.

20. A supporting element according to claim 18, wherein said flexible composition is filled substantially flush with an outer surface of said casing adjacent said stress-relieving region.

21. A supporting element according to claim 18, wherein the flexible composition is dyed such that it is visually distinguishable from a surrounding region.

22. A supporting element according to claim 15, wherein said supporting body comprises a composite fiber material.

23. A supporting element according to claim 22, wherein said composite fiber material is selected from the group consisting of carbon fiber-reinforced reaction resin and fiberglass composite.

24. A supporting element according to claim 22, wherein said metallic material is selected from the group consisting of aluminum and steel.

25. The supporting element of claim 15, wherein the stress-relieving region is disposed in a critical stress zone of said casing.

26. A method of utilizing a hollow metallic cylindrical casing on a cylindrical support comprising:

providing a hollow metallic cylindrical casing and a cylindrical support;

disposing said cylindrical casing on said support so as to preclude relative movement between said casing and said support;

forming an annular groove in said cylindrical surface of said cylindrical casing;

retaining on said cylindrical casing an annular region of reduced metal thickness underlying said annular groove and establishing a predetermined breaking point of said annular region of reduced metal thickness upon subjecting said casing to alternating bending loads which exceed said predetermined breaking point;

subjecting said casing to alternating bending loads which exceed said predetermined breaking point;

selectively breaking said casing at said annular region of reduced thickness;

producing flares and protruding edges of metallic material at said annular region of reduced thickness; and confining said metallic flares and protruding edges with said annular groove.

* * * * *